US007685947B2

(12) United States Patent
Moritzhuber

(10) Patent No.: US 7,685,947 B2
(45) Date of Patent: Mar. 30, 2010

(54) CABLE RAILWAY SYSTEM

(75) Inventor: Johannes Moritzhuber, Hard (AT)

(73) Assignee: Innova Patent GmbH, Wolfurt (AT)

( * ) Notice: Subject to any disclaimer, the term of this patent is extended or adjusted under 35 U.S.C. 154(b) by 0 days.

(21) Appl. No.: 12/269,257

(22) Filed: Nov. 12, 2008

(65) Prior Publication Data

US 2010/0043666 A1 Feb. 25, 2010

(30) Foreign Application Priority Data

Aug. 21, 2008 (AT) ..... A 1299/2008

(51) Int. Cl.
*B61B 7/00* (2006.01)

(52) U.S. Cl. ..... 104/180; 104/173.1; 104/173.2

(58) Field of Classification Search ..... 104/27, 104/28, 29, 30, 178, 179, 173.1, 184, 187
See application file for complete search history.

(56) References Cited

U.S. PATENT DOCUMENTS 3,987,734 A * 10/1976 Horn ..... 104/88.03
5,562,040 A * 10/1996 Egli ..... 104/173.1
5,575,215 A * 11/1996 Egli et al. ..... 104/99
5,873,310 A * 2/1999 Creissels et al. ..... 104/173.2
6,393,995 B1 * 5/2002 Mugnier ..... 104/173.1
6,729,241 B2 * 5/2004 Gabriel et al. ..... 104/173.1
2007/0251407 A1 * 11/2007 Gabriel ..... 104/180
2009/0064890 A1 * 3/2009 Charrere et al. ..... 104/89

FOREIGN PATENT DOCUMENTS

EP 1 849 674 A1 10/2007

* cited by examiner

*Primary Examiner*—S. Joseph Morano
*Assistant Examiner*—Jason C Smith
(74) *Attorney, Agent, or Firm*—Laurence A. Greenberg; Werner H. Stemer; Ralph E. Locher

(57) ABSTRACT

A cable railway system has a valley station and at least one mountain station. Transport vehicles such as cable cars are moved along a carrying and conveying cable and they are uncoupled from the cable in the stations and moved through the stations along a guide rail. The passengers board and disembark from the cable cars in entry and exit areas. Switches are disposed along the course of the guide rail for selectively moving a first group of cable cars along a first guide path and a second group along a second guide path through the entry and exit area. A common entry and exit area for the passengers is associated with the two groups of vehicles and disposed between the two guide paths. Entry and exit doors of the first group of vehicles open on a first side of the same and entry and exit doors of the second group of vehicles open on a second side, such that they face the common entry and exit area.

8 Claims, 4 Drawing Sheets

CABLE RAILWAY SYSTEM

CROSS-REFERENCE TO RELATED APPLICATION

This application claims the priority, under 35 U.S.C. §119, of Austrian patent application A 1299/2008, filed Aug. 21, 2008; the prior application is herewith incorporated by reference in its entirety.

BACKGROUND OF THE INVENTION

Field of the Invention

The present invention relates to a cable railway system with a valley station and at least one mountain station. A carrying and conveying cable extends between the stations and is guided in or at the stations by way of deflection pulleys, at least one of which is driven. Transport vehicles, such as cable cars, lift chairs, or gondolas, are uncoupled from the carrying and conveying cable in the stations and are moved through the stations along a guide rail, so that the passengers board or respectively disembark from the cable cars or chairs in entry and exit areas. At least two switches are provided within the course of the guide rail, by way of which vehicles of a first group are moved along a first guide path and vehicles of a second group are moved along a second guide path through the at least one entry and exit area in the respective station.

A cable railway system of that type, made known from commonly assigned U.S. published patent application US 2007/0251407 A1 and its counterpart European published patent application EP 1849674 A1, is realized with two entry and exit areas on one side for skiers with skis fastened on and on the other side for passengers with no skis fastened on. The speed of the vehicles as they are moved through the entry and exit area that is used by passengers that have no skis attached is slower that through the other entry and exit area. In the case of that prior cable railway system, the two entry and exit areas are spatially separate from one another.

In the case of other known cable railway systems, which are realized in a station with only one single entry and exit area through which the vehicles are guided along a guide path, a plurality of vehicles, which the passengers can board or disembark from, are guided through the entry and exit area and are made available to the passengers.

SUMMARY OF THE INVENTION

It is accordingly an object of the invention to provide a cableway system, which overcomes the above-mentioned disadvantages of the heretofore-known devices and methods of this general type and which is capable of doubling the number of vehicles that are available to the passengers in the entry and exit area without creating a requirement for additional space to do this.

With the foregoing and other objects in view there is provided, in accordance with the invention, a cable railway system, comprising:

a valley station and at least one mountain station, a carrying and conveying cable extending between the stations and guided in the stations by way of deflection pulleys, the pulleys including at least one driven pulley, and guide rails disposed in the stations;

vehicles, such as cable cars, gondolas, or the like, configured to transport passengers along the carrying and conveying cable between the stations while being coupled to the carrying and conveying cable, and wherein the vehicles are uncoupled from the carrying and conveying cable in the stations and moved through the stations along the guide rails, the vehicles being formed with entry and exit doors enabling passengers to board the vehicles or disembark from the vehicles at respective entry and exit areas defined in the stations;

at least two diverter switches disposed along a course of the guide rails, the switches being disposed to divert respective vehicles of a first group to move along a first guide path and respective vehicles of a second group to move along a second guide path through the at least one entry and exit area in the respective the station;

wherein a common entry and exit area for the passengers is associated with first and second groups of vehicles, the common entry and exit area being located between the first and second guide paths;

wherein the doors of the first group of vehicles are disposed on a first side thereof and the doors of the second group of vehicles are disposed on a second side thereof, such that the doors of the first and second group of vehicle face towards the common entry and exit area.

In accordance with another feature of the invention, some or all of the vehicles have doors on both sides thereof. In that case, the doors facing towards the common entry and exit area are openend as the respective vehicle traverses the entry and exit area.

In other words, the objects of the invention are achieved with a cable railway system of the above type in that a common entry and exit area for the passengers is associated with the two groups of vehicles, the common entry and exit area being situated between the two guide paths, wherein the entry and exit doors of the first group of vehicles are situated on a first side of the same and the entry and exit doors of the second group of vehicles are situated on a second side of the same, such that they face the common entry and exit area or respectively wherein at least one part of the vehicles is realized with doors on both sides and the respective doors facing the entry and exit area are opened.

This means that the conveying capacity of a cable railway system is increased in a simple manner, without there being a requirement for additional space to achieve this and the boarding procedure is therefore simplified for the passengers because double the number of cable cars are available.

A plurality of vehicles of the two groups are preferably moved through the entry and exit area at the same time at a speed of approximately 0.25 m/sec. In addition, in the entry and exit area the movement of the passengers towards the vehicles or respectively away from the vehicles is preferably directed in opposition to the movement of the vehicles.

According to another specific embodiment, at least three pairs of switches that are associated with each other are provided in the path of movement of the vehicles through the station, four guide paths thereby being formed, wherein in each case two guide paths have associated therewith a common entry and exit area, which is situated between the first and the second guide path and between the third and the fourth guide path.

Other features which are considered as characteristic for the invention are set forth in the appended claims.

Although the invention is illustrated and described herein as embodied in a cable railway system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
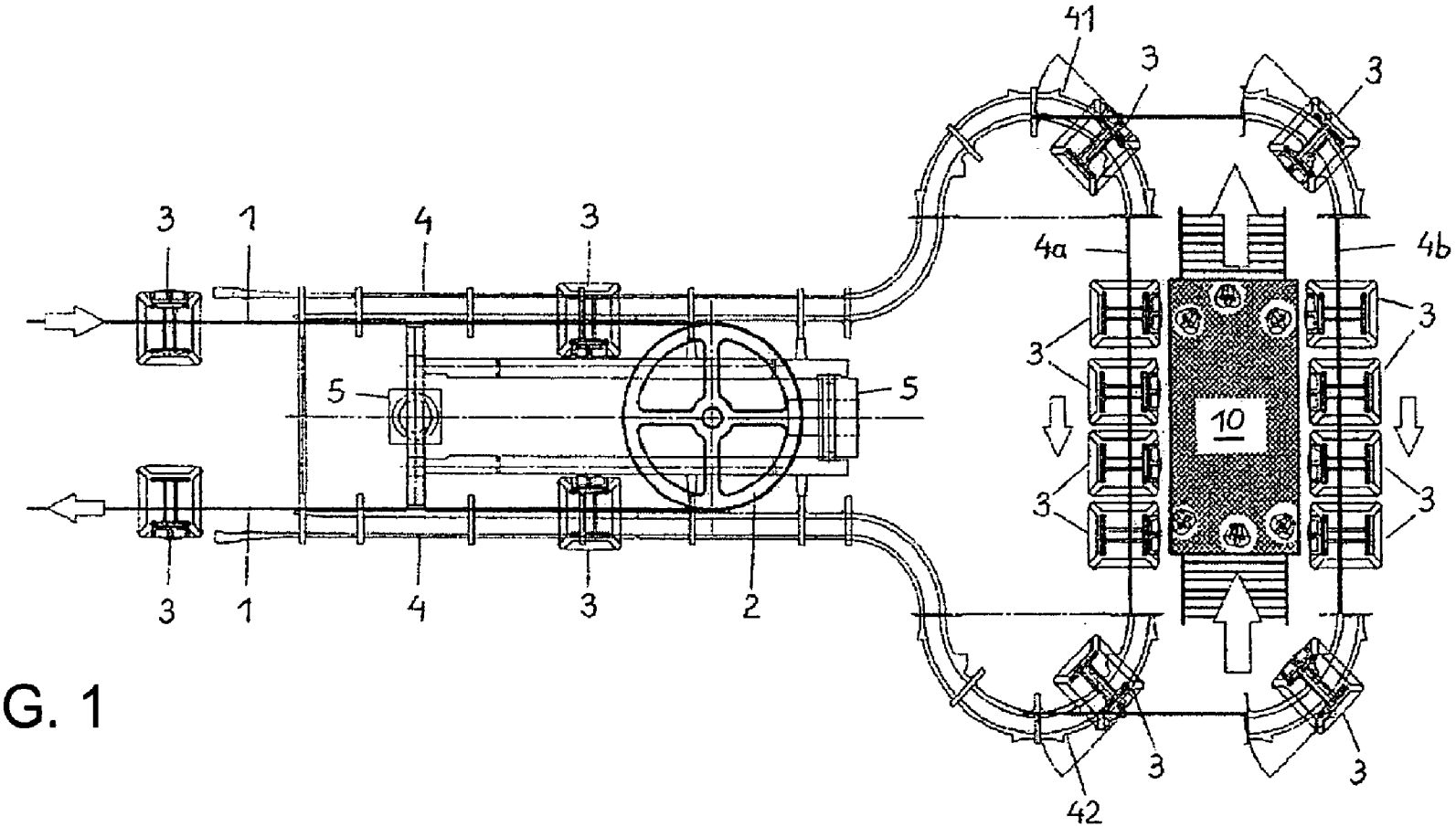
FIG. 1 is a plan view onto a first exemplary embodiment of a cable railway system according to the invention.
Figure 1A:
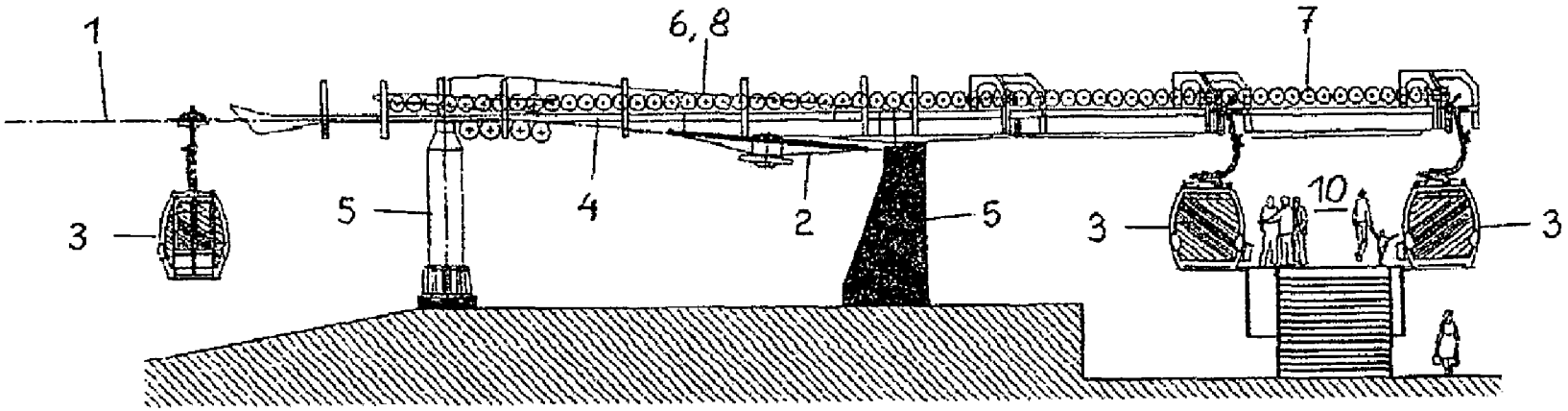
FIG. 1A is a corresponding side view thereof.

Referring now to the figures of the drawing in detail and first, particularly, to FIGS. 1 and 1A thereof, the invention is implemented in a station of a cable railway system. The cable railway system, also referred to as a cableway system or a cable railroad, includes a carrying and conveying cable 1, which is guided in the station by means of a deflection pulley 2. At least one of the deflection pulleys of the cable railway system is a driven pulley. In addition, there are provided cable cars 3, which are coupled to the carrying and conveying cable 1 along the section of the cable railway system and are thereby moveable from a first station, for example the valley station, to a second station, for example the mountain station.

The cable cars 3 are uncoupled from the carrying and conveying cable 1 in the stations and are then moved through the station along a guide rail 4, which is supported by supports 5. The carrying and conveying cable 1 is moved at a speed of approximately 6 m/sec. The speed of the cable cars 3 is slowed down in the stations by means of decelerating tires 6, the said cable cars then being moved by means of conveying tires 7 at a speed of approximately 0.25 m/sec through an entry and exit area 10 provided in the station for the passengers. After leaving the entry and exit area 10, the cable cars 3 are accelerated by means of accelerating tires 8 to a speed of 6 m/sec, at which speed they are once again coupled to the carrying and conveying cable 1 and are thereby moved towards another station.

The embodiment summarized in the two foregoing paragraphs is generally known from the state of the art. The embodiment of a station according to the invention differs from prior art stations in that the guide rail 4 is realized in the entry and exit area 10 with two paths, between which is situated the entry and exit area 10. To this end, a first diverter or switch 41 is provided within the course of the guide rail 4, a first guide path 4*a* and a second guide path 4*b* connecting to the said switch, the said two guide paths 4*a* and 4*b* passing, after the entry and exit area 10, into the guide rail 4 by means of a second switch 42. Consequently, the entry and exit area 10 is situated between the two guide paths 4*a* and 4*b*. By controlling the switch 41 in an appropriate manner, the individual cable cars 3 are either moved along the first guide path 4*a* or along the second guide path 4*b*. So that the cable cars 3 can be boarded or disembarked from by the passengers in the entry and exit area 10, the cable cars 3 are realized either with a door which is situated on the side of the cable car 3 facing the entry and exit area 10, or the cable cars 3 are realized with a door on each side, wherein, with the cable railway system in operation, the respective door opening is the one which is facing the entry and exit area 10.

Through this embodiment of the station of a cable railway system, twice the number of cable cars 3 to be boarded are available to the passengers, compared to known stations, the boarding process thereby being simplified for the passengers without there being a requirement for additional space to accomplish this. The direction of the movement of the passengers into the entry area 10 is effected, in this case, in opposition to the direction of movement of the cable cars. The passengers ascend to the level of the entry platform by way of stairs and/or an escalator or the like in countercurrent to the travel direction of the cable cars. Disembarking passengers exit the platform by descending via stairs and/or escalators on the opposite side.

Figure 2:
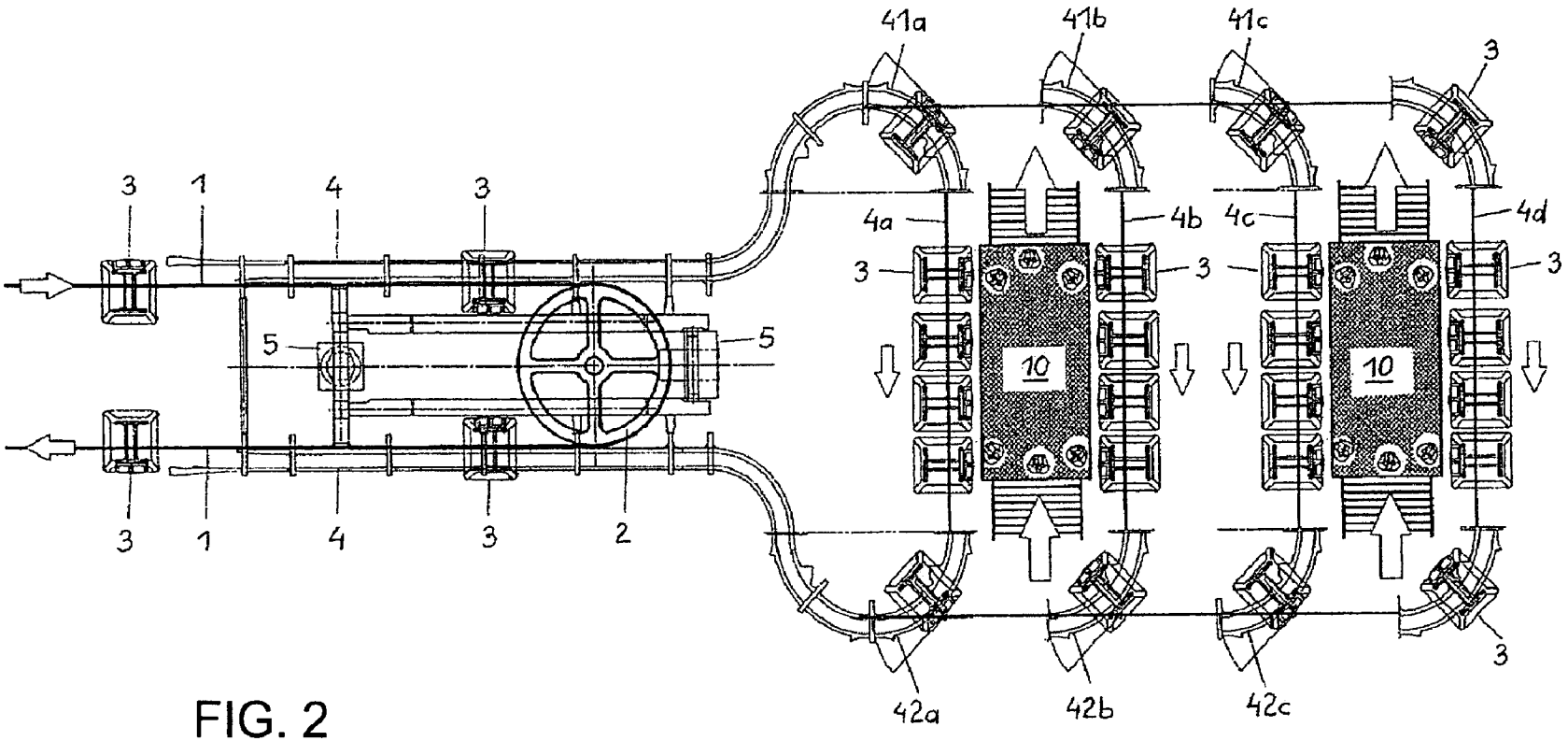
FIG. 2 is a plan view onto a second exemplary embodiment of a cable railway system according to the invention.
Figure 2A:
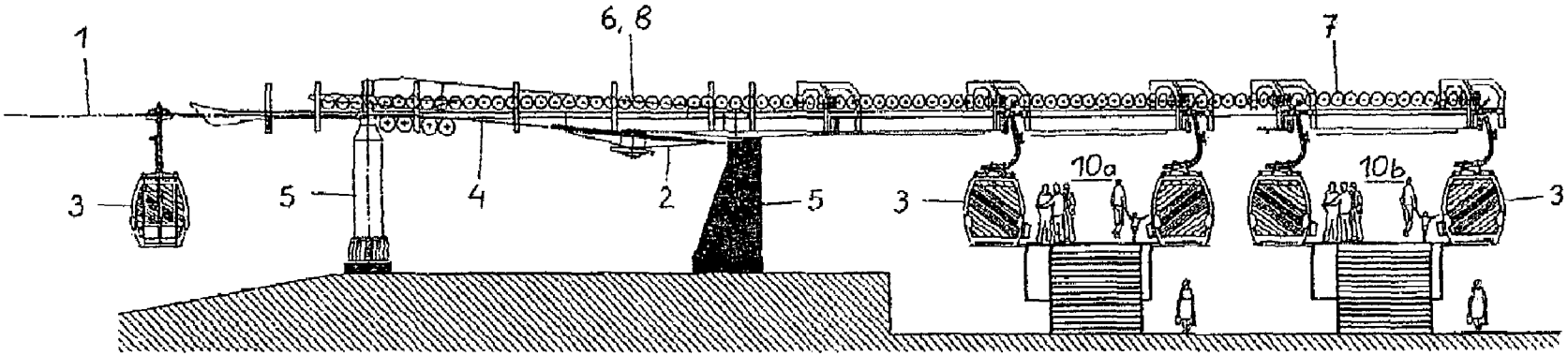
FIG. 2A is a corresponding side view thereof.

The specific embodiment represented in FIGS. 2 and 2A differs from the specific embodiment in FIGS. 1 and 1A in that three pairs of switches 41*a*, 42*a*; 41*b*, 42*b*; 41*c*, 42*c* are provided in the guide rail 4, four guide paths 4*a*, 4*b*, 4*c* and 4*d* being formed thereby in total, a first entry and exit area 10*a* being situated between a first and a second guide path 4*a*, 4*b* and a second entry and exit area 10*b* being situated between a third and a fourth guide path 4*c*, 4*d*. This means that the conveying capacity of the cable railway system can be increased even further.

Sensors are provided for the operation of the cable railway system, by means of which sensors the switches and the conveying tires are controlled such that collisions between the individual cable cars are avoided.

The invention claimed is:

1. A cable railway system, comprising:

a valley station and at least one mountain station, a carrying and conveying cable extending between said stations and guided in said stations by way of deflection pulleys, said pulleys including at least one driven pulley, and guide rails disposed in said stations;

vehicles configured to transport passengers along said carrying and conveying cable between said stations while being coupled to said carrying and conveying cable, and wherein said vehicles are uncoupled from said carrying and conveying cable in said stations and moved through said stations along said guide rails, said vehicles being formed with entry and exit doors enabling passengers to board said vehicles or disembark from said vehicles in said stations;

at least two diverter switches disposed along a course of said guide rails, said switches being disposed to divert respective vehicles of a first group to move along a first guide path and respective vehicles of a second group to move along a second guide path through the respective said station;

wherein a common entry and exit area for the passengers is associated with first and second groups of vehicles, said common entry and exit area being located between said first and second guide paths;

wherein said doors of said first group of vehicles are disposed on a first side thereof and said doors of said second group of vehicles are disposed on a second side thereof, such that said doors of said first and second group of vehicles face towards said common entry and exit area.

2. The cable railway system according to claim 1, wherein at least some of said vehicles are formed with doors on both sides thereof, and wherein said doors facing towards said common entry and exit area are opened as the respective said vehicle traverses said entry and exit area.

3. The cable railway system according to claim 1, wherein said vehicles are cable cars.

4. The cable railway system according to claim 1, wherein a plurality of vehicles of said first and second groups of vehicles are moved through said entry and exit area at a common speed of approximately 0.25 m/sec.

5. The cable railway system according to claim 1, wherein said entry and exit area is configured for movement of the passengers towards the vehicles and respectively away from the vehicles in opposing direction to a direction of movement of said vehicles through said entry and exit area.

6. The cable railway system according to claim 1, wherein said at least two diverter switches belong to at least three respectively associated pairs of switches disposed along a path of movement of said vehicles through the respective said station and defining first, second, third, and fourth guide paths, and wherein said common entry and exit area is a first common entry and exit area disposed between said first and second guide paths and including a second common entry and exit area disposed between said third and fourth guide paths.

7. The cable railway system according to claim 1, wherein said common entry and exit area is formed by a raised platform disposed between said first and second guide paths, and wherein passengers ascend to said raised platform for embarking said vehicles and descend from said raised platform after disembarking from said vehicles.

8. The cable railway system according to claim 7, wherein said vehicles travel along said first a second guide paths adjacent said raised platform in a given travel direction, and the passengers ascend said raised platform and descend from said raised platform in a direction counter to the given travel direction.

* * * * *